US006394422B1

(12) United States Patent
Jones et al.

(10) Patent No.: US 6,394,422 B1
(45) Date of Patent: May 28, 2002

(54) DECORATIVE SCROLL FOR A BALUSTER

(75) Inventors: Kelly D. Jones, High Ridge; Ryan P. Nielsen, St. Louis, both of MO (US)

(73) Assignee: Deckorators, Inc., St. Louis, MO (US)

( * ) Notice: Subject to any disclaimer, the term of this patent is extended or adjusted under 35 U.S.C. 154(b) by 0 days.

(21) Appl. No.: 09/611,647

(22) Filed: Jul. 7, 2000

(51) Int. Cl.[7] ..... E04F 11/16
(52) U.S. Cl. ..... 256/65; 256/69; 256/1
(58) Field of Search ..... 256/1, 21, 22, 256/59, 65, 68, 69, 24, 34; 403/12–14, 391, 389, 398, 399, 385, 362; 243/230.6, 231.71; D25/38–44

(56) References Cited

U.S. PATENT DOCUMENTS

| | | | | | |
|---|---|---|---|---|---|
| 345,769 | A | | 7/1886 | Cary | 5/281 |
| 372,254 | A | * | 10/1887 | Cooper | 256/22 |
| 1,043,260 | A | * | 11/1912 | Shover | 403/398 |
| 2,970,798 | A | * | 2/1961 | Fritchle et al. | 248/229.25 |
| 3,373,965 | A | | 3/1968 | Bien et al. | 248/205.1 |
| 3,425,127 | A | * | 2/1969 | Long et al. | 248/230.6 X |
| 3,745,615 | A | | 7/1973 | Oberreich | 24/259 |
| 4,016,699 | A | | 4/1977 | Hurvitz | 52/663 |
| 4,018,538 | A | | 4/1977 | Smyrni et al. | 403/346 |
| 4,022,435 | A | | 5/1977 | Glass | 256/1 |
| 4,390,309 | A | * | 6/1983 | Gangmann | 408/76 |
| 4,945,703 | A | | 8/1990 | Mascotte | 52/663 |
| 5,421,556 | A | | 6/1995 | Dodge et al. | 256/1 |
| 5,685,343 | A | | 11/1997 | Smith | 138/89 |
| 5,820,111 | A | * | 10/1998 | Ross | 256/65 |

* cited by examiner

*Primary Examiner*—Lynne H. Browne
*Assistant Examiner*—John R. Cottingham
(74) *Attorney, Agent, or Firm*—Grace J. Fishel

(57) ABSTRACT

A decorative scroll for a round baluster. The scroll is preferably sand cast of aluminum and attached to the baluster with screw through a plate having centering elements for secure three-point contact. The scroll with the baluster for use in emulating a wrought iron fence or railing.

10 Claims, 2 Drawing Sheets

DECORATIVE SCROLL FOR A BALUSTER

BACKGROUND OF THE INVENTION

1. Field of the Invention

The present invention relates to a decorative scroll for mounting on a round baluster for use in emulating a wrought iron fence or railing.

2. Brief Description of the Prior Art

Wrought iron fences and railings are formed with balusters that are rectangular in cross-section and are frequently decorated with metallic scrolls, in various designs. The metallic scrolls are traditionally formed of the same material as the fence and are attached to the balusters with a U-shaped bracket having a flat bottom and right-angled legs engaging a pair of laterally spaced scroll members. The complementarily shaped baluster is received in the bracket and the scroll is attached by welding, screws, bolts or the like.

Wrought iron fences are expensive and require constant painting to prevent rusting. A wooden fence or railing is less costly but not as elegant. Typically, the balusters in a wooden fence or railing are 2×2's, joined top and bottom with a rail. The wooden balusters obscure the view and also require constant painting or staining to maintain their appearance.

Recently, it has been found that an attractive fence or railing can be made with round, metal balusters mounted in holes drilled in top and bottom wooden rails. For ease in maintenance, it is preferred that the balusters be made of aluminum and finished with a durable, baked-on enamel. When aluminum scrolls, preferably prefinished and made in wrought iron molds, are mounted on the balusters, the resulting fence or railing emulates a wrought iron fence, without the cost or maintenance. It is difficult, however, to attach a scroll designed for a baluster with a rectangular cross-section to a round baluster. In addition, when a scroll with a flat-bottomed bracket is attached with a screw to a round baluster, it is difficult to drive the screw radially into the baluster and the screw tends to loosen if the scroll is rocked. Rounding the inside of the U-shaped bracket to fit the outside of a round baluster for tight contact is not a practical solution as the scroll is sand cast for economy and sand castings are not that dimensionally precise.

BRIEF SUMMARY OF THE INVENTION

In view of the above, it is an object of the present invention to provide a decorative scroll for use in connection with a round baluster in forming attractive fences and railings. It is another object to provide a scroll which is easy to install and which is not easily loosened in use. It is also an object to provide a scroll which may be sand cast of aluminum and finished with durable coating. Other objects and features of the invention will be in part apparent and in part pointed out hereinafter.

In accordance with the invention, a decorative scroll for a round baluster for use in a fence, railing or some other structure employing vertical pickets makes three-point contact with the baluster. The scroll includes a plate with front and rear sides and first and second ends. The rear side of the plate is concave and has at least two centering elements. A pair of laterally spaced scroll members are secured on the rear side of the plate. The scroll members have proximal surfaces which approach one another, with the approaching surfaces at the plate spaced apart a distance slightly greater than the diameter of the baluster. The scroll is attached with a screw passing through a hole in the plate, engaging the baluster and drawing the rear side of the plate against the baluster. As seen in FIG. 3, the screw and the centering elements make three-point contact with the baluster for secure mounting of the scroll.

A scroll as described above is attached to a round baluster by positioning the scroll on the baluster with the rear side of the plate against the baluster. A screw is then driven through the plate and into the baluster for drawing the rear side of the plate against the baluster, whereby the screw and the centering elements make three-point contact with the baluster for secure mounting of the scroll.

The invention summarized above comprises the constructions and methods hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
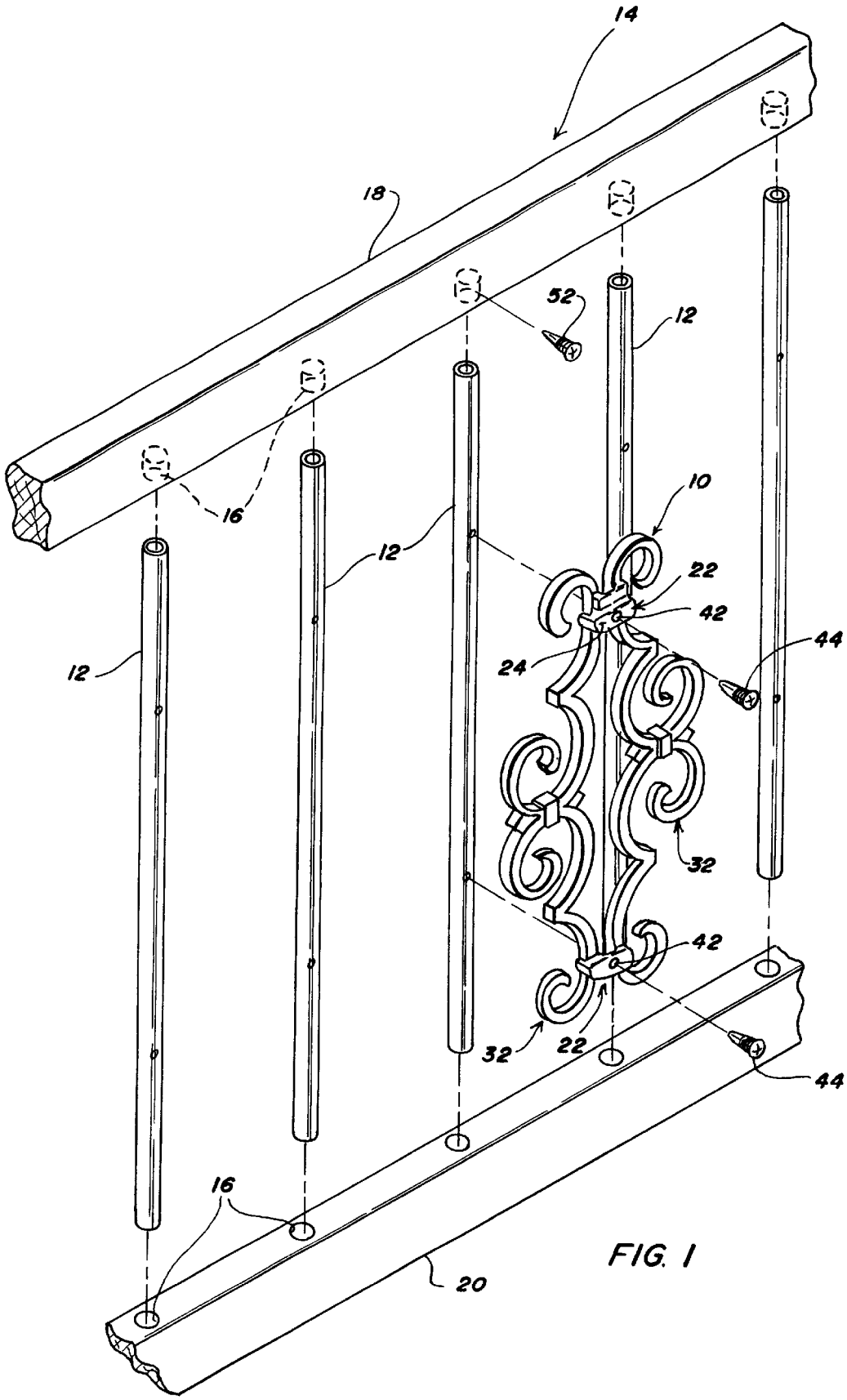
FIG. 1 is a perspective front view of a decorative scroll in accordance with the present invention mounted on a baluster in a structure employing vertical pickets.

Referring to the drawings more particularly by reference character, reference numeral 10 refers to a decorative scroll in accordance with the present invention. Scroll 10 is adapted for use on a baluster 12. As shown in FIG. 1, a plurality of balusters 12 are mounted in a structure 14 employing vertical pickets such as a fence, railing or the like. Opposite ends of balusters 12 are received in holes 16 provided in an upper and a lower rail 18, 20, respectively. Rails 18, 20 are preferably formed of wood, such as 2×4's, but may be formed of plastic, composite materials, etc. For installation in rails 18, 20, balusters 12 must be substantially circular in cross-section as it is not practical to drill other than round holes. A silicon caulk is applied to holes 16 in lower rail 20 to protect balusters 12 from moisture.

Figure 2:
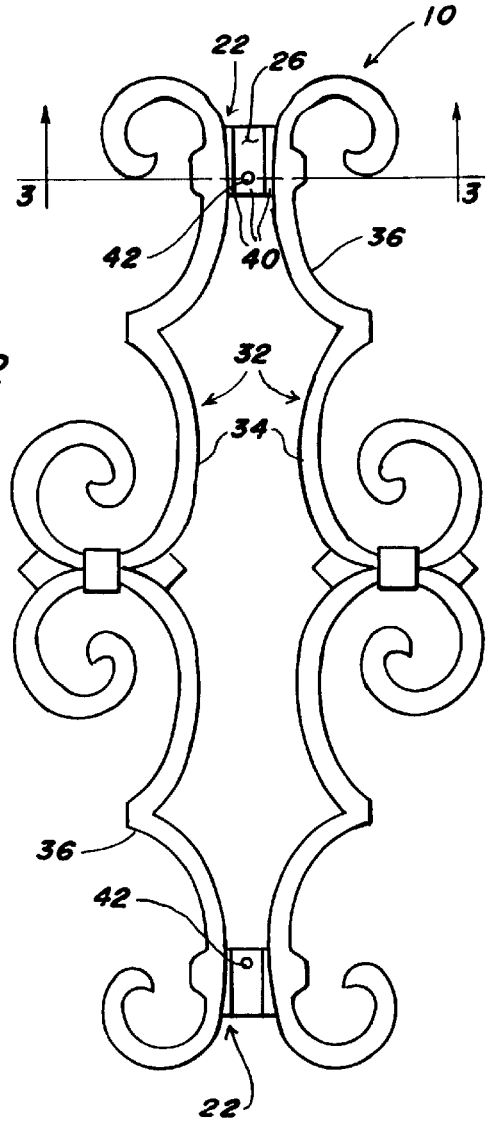
FIG. 2 is a rear plan view of the scroll.

Scroll 10 has a plate 22 with front and rear sides 24, 26 and first and second ends 28, 30, respectively. A pair of laterally spaced scroll members 32 are secured to rear side 26 of plate 22. Scroll members 32 have a proximal surface 34 and a distal surface 36. The proximal surfaces 34 approach one another at plate 22, with the approaching surfaces being substantially flat sections spaced apart a distance slightly greater than the diameter of baluster 12. A pair of right-angled legs 38 are attached to plate 22 and engage distal surfaces 36 of scroll members 32. Legs 38 with plate 22 simulate a U-shaped bracket associated with old-time wrought iron scrolls. In modern wrought iron scrolls, legs 38 and plate 22 are not separate members but are sand cast as a unit with scroll members 32. As shown in FIGS. 1–2, scroll 10 may be attached to baluster 12 with more than one plate 22 and scroll members 10 may be formed into other patterns (not shown).

Rear side 26 of plate 22 has centering elements 40 with a concave profile. Suitable elements 40 include nubs, webs, non-coplanar flats and the like. Within the dimensional limitations of a sand casting, there may be more or less centering elements, although three flats are preferred for use as described below. A screw 44 is provided for engaging baluster 12 through a hole 42 in plate 22. Hole 42 may be formed when scroll 10 is cast or by screw 44 as it penetrates plate 22 or by some other method. For this purpose, it is preferred that screw 44 be self tapping and hole 44 be countersunk with inwardly tapering sidewalls 46.

Baluster 12 is formed of a non-ferrous metal, preferably extruded aluminum and may be provided in several lengths such as 26 and 32 inches. Preferably baluster 12 has a baked-on enamel finish, which may be offered in a range of colors, in addition to black or white. Scroll 10 is formed of a non-ferrous metal, preferably the same material as baluster to prevent galvanic action when the parts are attached together. For purposes of economy, scroll 10 is preferably sand cast and for ease of maintenance provided with a powdercoat finish. Like baluster 12, scroll 10 may be offered in a range of colors, in addition to black or white. When installed, scroll 10 may be the same color as baluster 12, or may contrast or harmonize with it, depending on a user's preference.

Figure 3:
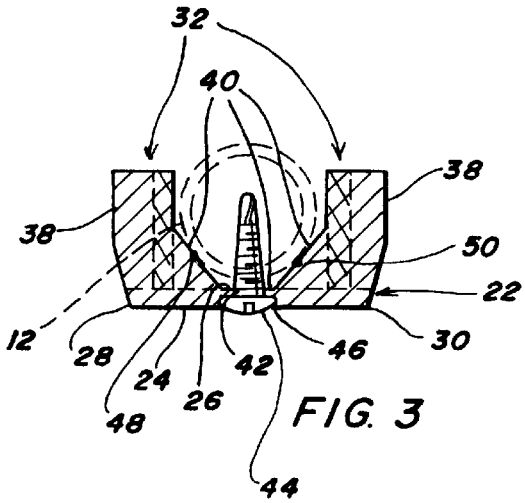
FIG. 3 is a cross-section taken along the line 3—3 in FIG. 2; and, FIG. 4 is a view similar to FIG. 3 but showing a U-shaped bracket of a prior art scroll.
Figure 4:
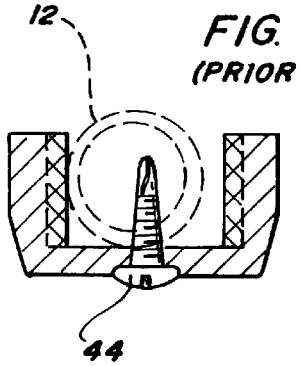
FIG. 4 (PRIOR ART)

In use, after balusters 12 have been assembled with rails 18, 20 into a fence or railing 14, a scroll 10 as described above is positioned on a selected baluster 12 with rear side 26 of plate 22 against baluster 12. Before screw 44 is driven through plate 22, rear side 26 of plate 22 makes two-point contact 48, 50, respectively, the spread of which depends on the angle that centering elements such as non-coplanar flats 40 make with respect to each other. Points 48, 50 keep baluster 12 centered on plate 22, such that screw 44 penetrates baluster 12 radially after it is driven through plate 22 as shown in FIG. 3. This differs from the prior art U-shaped bracket as shown in FIG. 4, where baluster 12 may shift on plate 22 such that screw 44 follows a chord, not passing through the center of baluster 12. With returning reference to FIG. 3, it is seen that screw 44, radially driven into baluster 12, establishes a third point of contact for secure three-point mounting of the scroll.

When scroll 10 is attached with more than one plate 22, the procedure described above is repeated at each plate, another screw 44 being provided for that purpose.

After scroll 10 is attached to baluster 12, baluster 12 may be rotated in holes 16 such that scroll 10 faces outwardly in the fence or railing 14. To secure this placement, another screw 52 is provided for use as a set screw in upper rail 18. As shown in FIG. 1, screw 52 is driven through upper rail 18 into hole 16, making contact with baluster 12 upon which scroll 10 is mounted.

In view of the above, it will be seen that the several objects of the invention are achieved and other advantageous results attained. As various changes could be made in the above constructions and methods without departing from the scope of the invention, it is intended that all matter contained in the above description or shown in the accompanying drawings shall be interpreted as illustrative and not in a limiting sense.

What is claimed:

1. A decorative scroll for a baluster in a structure employing vertical pickets, said baluster being substantially circular in cross-section, said scroll comprising a plate with front and rear sides and first and second ends, said rear side of the plate having a concave profile with non-frangible centering elements; and, a pair of laterally spaced scroll members secured on the rear side of the plate, said scroll members having proximal surfaces which approach one another, said approaching surfaces spaced apart a distance slightly greater than the diameter of the baluster, said scroll members at the approaching surfaces with the concave rear side of the plate being of a depth substantially equal to the diameter of the baluster, and, a screw for engaging the baluster through the plate and drawing the centering elements against the baluster, whereby the screw and the centering elements make three-point contact with the baluster for secure mounting of the scroll.

2. The scroll of claim 1 wherein the centering elements are two non-coplanar flats.

3. The scroll of claim 2 wherein the plate and the scroll members are sand cast of aluminum.

4. A decorative scroll for a baluster in a structure employing vertical pickets, said baluster being substantially circular in cross-section, said scroll comprising a plate with front and rear sides and first and second ends, said rear side of the plate being concave and having at least two non-coplanar, non-frangible flats;

a pair of laterally spaced scroll members secured on the rear side of the plate, said scroll members having proximal surfaces which approach one another at opposing substantially flat sections, said substantially flat sections spaced apart a distance slightly greater than the diameter of the baluster, said flat sections with the concave rear side of the plate being of a depth substantially equal to the diameter of the baluster, a screw for engaging the baluster through the plate and drawing the flats against the baluster, whereby the screw and the flats make three-point contact with the baluster for secure mounting of the scroll.

5. The scroll of claim 4 wherein the plate and the scroll members are sand cast of aluminum.

6. The scroll of claim 4 wherein a hole is provided in the plate for the screw, said hole being countersunk with an inwardly tapered sidewall.

7. A method for attaching a decorative scroll to a baluster in a structure employing vertical pickets, said baluster being substantially circular in cross-section, comprising (a) selecting a scroll having a plate with front and rear sides and first and second ends, said rear side of the plate having a concave profile with non-frangible centering elements;

a pair of laterally spaced scroll members secured on the rear side of the plate, said scroll members having proximal surfaces which approach one another, said approaching surfaces spaced apart a distance slightly greater than the diameter of the baluster, said scroll members at the approaching surfaces with the concave rear side of the plate being of a depth substantially equal to the diameter of the baluster, (b) positioning the scroll on the baluster with the centering elements against the baluster; and, (c) driving a screw through the plate and into the baluster for drawing the centering elements against the baluster, whereby the screw and the centering elements make three-point contact with the baluster for secure mounting of the scroll.

8. The method of claim 7 wherein the centering elements are two non-coplanar flats.

9. The method of claim 8 wherein the plate has a countersunk hole with an inwardly tapered sidewall in the front side for guiding the screw through the plate and into the baluster.

10. The method of claim 9 wherein the baluster and the scroll are formed of aluminum.

* * * * *